United States Patent [19]

Fogg

[11] 4,087,012

[45] May 2, 1978

[54] ASSEMBLY LINE CONTAINER INVERTER

[75] Inventor: Daniel A. Fogg, Fremont, Mich.

[73] Assignee: Gerber Products Company, Fremont, Mich.

[21] Appl. No.: 788,194

[22] Filed: Apr. 18, 1977

[51] Int. Cl.[2] ..... B65G 65/04

[52] U.S. Cl. ..... 214/312; 198/857

[58] Field of Search ..... 198/403, 470, 803, 857; 214/300, 311, 312; 53/167; 134/104, 133, 152, 67-69; 15/304, 306 B

[56] References Cited

U.S. PATENT DOCUMENTS

| | | | |
|---|---|---|---|
| 970,758 | 9/1910 | Seidel | 134/69 |
| 1,053,632 | 2/1913 | Mulholland | 198/857 |
| 1,827,553 | 10/1931 | Algeo et al. | 134/67 |
| 2,189,586 | 2/1940 | Lallement | 134/69 |
| 2,685,956 | 8/1954 | Hoban | 198/857 |
| 2,865,411 | 12/1958 | Johnson et al. | 214/312 |
| 3,159,164 | 12/1964 | McBrady | 134/69 |
| 3,739,489 | 6/1973 | Macone | 198/803 |

*Primary Examiner*—Lawrence J. Oresky
*Attorney, Agent, or Firm*—Townsend and Townsend

[57] ABSTRACT

A container inverter for use in a conveyor flow path, and particularly adapted for use with open, upright cereal-type boxes, includes a ferris wheel mechanism within a cylindrical housing which is aligned along the direction of conveyor flow. The apparatus sequentially receives containers, incrementally translates them in an inverting arc transverse to the axis of conveyor flow while vigorously shaking the containers, and returns the containers to conveyor flow in an upright position. A rotary indexing system, including solenoid activated pneumatic relays, a sensor at the receiving station and a timing control, assures that the ferris wheel holds position when receiving containers in order to prevent undesired jamming.

5 Claims, 4 Drawing Figures

ASSEMBLY LINE CONTAINER INVERTER

BACKGROUND OF THE INVENTION

1. Field of the Invention

This invention relates to apparatus for clearing open topped containers of debris prior to filling, and particularly to an apparatus for inverting cardboard cereal boxes to clear away debris.

Preliminary to the packaging of cereal in conventional cardboard containers having a metallic pour spout is the installation of the pour spout in an end wall of the container. The conventional equipment which accomplishes the attachment of the pour spout frequently produces fragments of excess metal which may fall within the confines of the container. As a consequence, it is necessary to clear the container of debris. This may be accomplished by inversion of the container while it is still open, thereby discharging such loose contents.

In the process of packaging, cereal boxes are sequentially conveyed along the conveyor belt between a spout-installing station and a filling station. In the past, it has frequently been the practice to manually empty debris from the boxes prior to packaging. In order to speed and to simplify the packaging procedure and to eliminate the tedium of package handling while assuring the purity and safety of the contents, it is desirable to provide an automatic cleaning apparatus.

2. Description of the Prior Art

One technique proposed for automated clearing of debris in open topped containers is inversion of the containers by means of a ferris wheel apparatus. One such container-inversion apparatus known to the art is described in U.S. Pat. No. 3,159,164, to McBrady. The McBrady apparatus comprises a drum having a plurality of serially arranged ferris wheel structures which receive and displace containers laterally out of the conveyor flow, carry the containers through inverting arcuate paths, flush the inverted containers with blasts of air, and discharge the container in an upright position downstream of the receiving point and along the same line of flow. The mechanism described in the McBrady patent has been found to be relatively large, slow, complex and cumbersome. Moreover, such devices may jam, which can be particularly detrimental to efficient high-speed and high volume assembly line operation.

SUMMARY OF THE INVENTION

In order to overcome the shortcomings of the devices known in the art, and to provide an automatic cleansing apparatus, an assembly line-mounted container dumping system has been devised which comprises an inverting apparatus including a single ferris wheel mechanism within a cylindrical or drum housing which has an axis aligned with the direction of assembly line travel. The inverting apparatus sequentially receives containers, such as cereal boxes, and upon sensing that the containers are correctly positioned, incrementally translates the containers by movement of the ferris wheel in an inverting arc transverse to the axis of conveyor flow. The apparatus returns the containers to the conveyor flow in an upright position after vigorously shaking the containers and without linear advancement along the conveyor flow line. In order to assure that the inlet of the ferris wheel mechanism properly receives an inflowing container, a sensor registers the proper placement of each container entering the ferris wheel mechanism before a rotary indexing operation is initiated. The control system for the indexing operation includes solenoid-activated pneumatic indexing and stopping cylinders and a timing means to prevent jamming of containers entering the ferris wheel mechanism.

As will be understood from the following detailed description of the invention, the mechanical simplicity of the invention allows for an equally simple and reliable control system which assures the desired dynamic operation of the device. The particular advantages of the invention will be apparent from an examination of the following detailed description.

DETAILED DESCRIPTION OF THE PREFERRED EMBODIMENT

Figure 1:
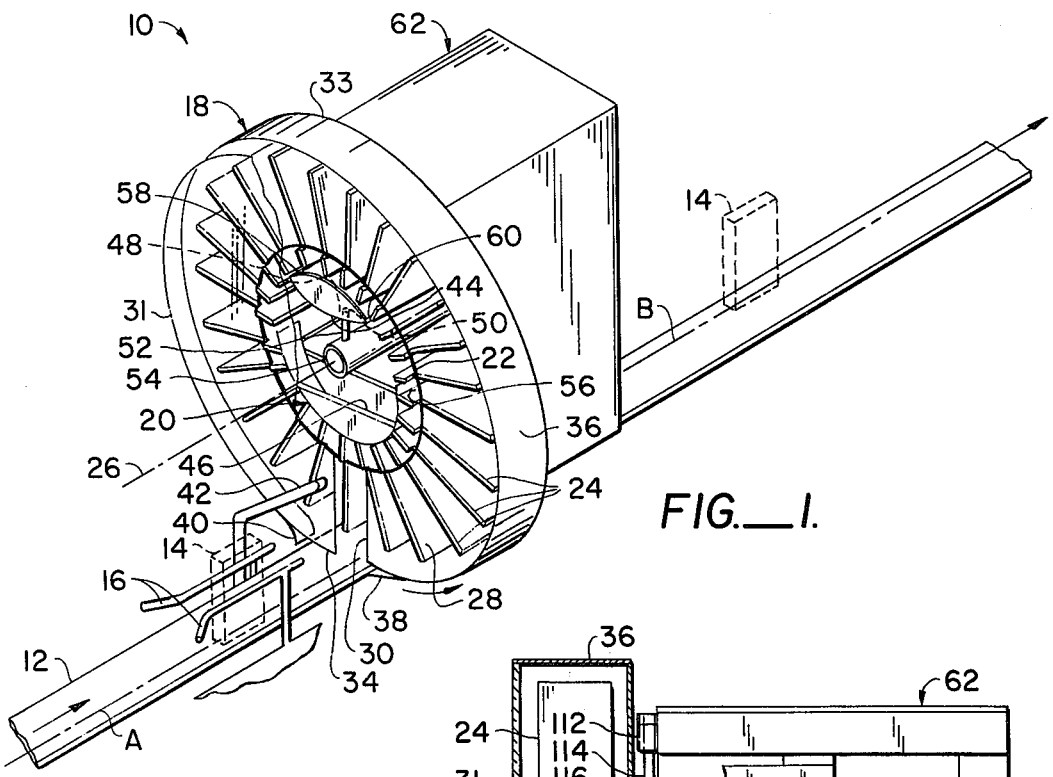
FIG. 1 is a frontal perspective view of the box-inverting apparatus according to the invention illustrating the placement of the apparatus along a conveyor belt.

The invention will be better understood upon referring to the drawings in conjunction with the following detailed description. The invention is described with particular reference to the cleansing of open topped boxes as generally used for packaging dried cereal. However, with some obvious changes, the invention may be adapted for use with other open topped containers.

In FIG. 1, a container inverter apparatus 10 is shown as it would be oriented to a conveyor belt 12 for carrying, for example, open topped cereal boxes 14. The cereal boxes 14 have been oriented and aligned upstream of the inverter apparatus 10 by suitable alignment means such as parallel rails 16. The parallel rails 16 are for directing the boxes 14 in an upright endwise position along a defined input path A.

The inverter 10 comprises a drum-shaped housing 18 enclosing a ferris wheel assembly 20. The ferris wheel 20 comprises a rotatable hub 22 and a plurality of partitions or blades 24 which are attached to and supported by hub 22. The blades 24 are aligned generally parallel to the axis of rotation 26 of the hub 22 and extend radially therefrom to define compartments 28. Each compartment 28 is of sufficient length, width and depth to receive a single box 14.

The housing 18 includes container inlet opening 30 in the upstream face 31 and a container outlet opening 32 (FIG. 3) in the downstream face 33 of the housing 18. The inlet opening 30 and the outlet opening 32 are part of a continuous opening including a circumferential or rim opening 34, which bridges the rim 36 of the drum housing 18 and which is disposed adjacent to the belt 12. The rim 36 of the housing 18 includes a circumferential intake skirt 38 adjacent the edge of the rim opening 34 at a level with the belt 12. The intake skirt 38 provides a moderately upwardly sloping ramp for guiding boxes 14 into the drum housing 18.

Along the rim 36 adjacent the outlet opening 32 is an outfeed skirt 40. The outfeed skirt 40 provides a relatively abrupt drop-off to permit containers about to exit from the drum housing 18 to fall relatively gently onto the belt 12.

In order to enhance the stability of box 14 dropping onto a rapidly moving belt 12, and particularly to prevent tumbling or tipping, as might be caused by such relative movement, an air jet 42 may be provided in the upstream face 31 opposite the outlet opening 32. The air jet 42 may be mounted just below the location of the upper lip of a box 14 as it would rest upon belt 12 in the exiting position. Air may be delivered continuously through the air jet 42 with sufficient velocity to counteract the rotational moment conveyed to a box 14 at that position by a rapidly moving belt 12.

The radially inner end of each compartment 28 is open to the center of the hub 22. Within the hub 22 are two upwardly opening trays or hoppers 44 and 46. The first hopper 44 is mounted above the second hopper 46 along about 45° to 60° of the arc of the hub 22. The first hopper 44 includes a floor 48 which tapers to a drain 50 which in turn is coupled through a tube 52 to a hollow shaft 54 disposed along the axis of rotation 26 about which the ferris wheel 20 can rotate. The second hopper 46 extends tangentially about 90° around the inner side 56 of the hub 22 to form a trough below the first hopper 44. The first hopper 44 is intended to capture the majority of debris which may tumble toward the center of the ferris wheel 20, and the second hopper 46 is for capturing any excess debris which may fall beyond the lateral edges 58 and 60 on the first hopper 44. The hollow shaft 54 is useful for removing the major portion of the unwanted debris. For example, the shaft 54 may be coupled at one end to a vacuum line (this is not shown) to draw off such material.

The drum housing 18 is mounted directly to a support frame 62 on the downstream side of the housing 18.

Figure 2:
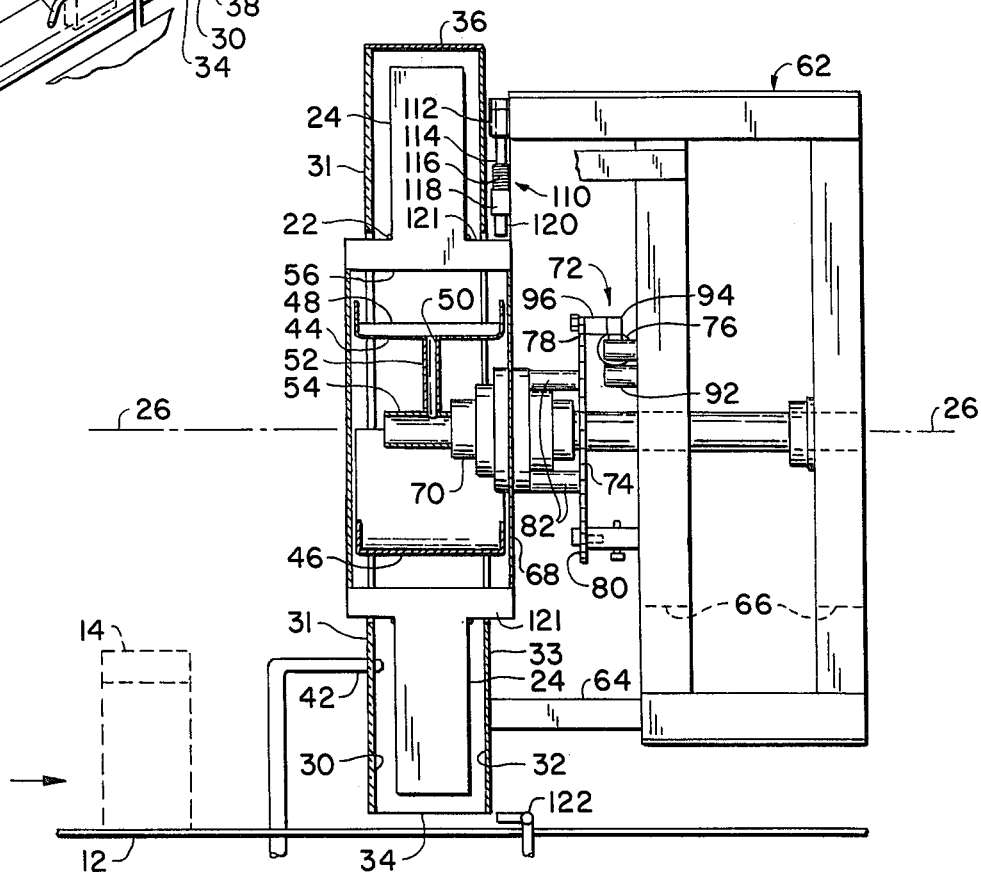
FIG. 2 is a side elevational view in partial cutaway and partial cross section illustrating the apparatus.

Referring particularly to FIG. 2, the frame 62 is seen to be joined to the housing 18 by angle bracket 64. A tunnel 66 is provided through the frame 62 to permit passage of boxes 14. If necessary, guide rails (not shown) similar in function to the guide rails 16 at the upstream side of the housing 18 may be included for laterally redirecting the boxes 14 into alignment with path A along the belt 12. Otherwise, the exiting boxes may follow a path B (FIG. 1) which is laterally offset from path A.

The drum housing 18, blades 24, hollow shaft 54 and hoppers 44 and 46, as described with FIG. 1, are illustrated in cross section in FIG. 2. The blades 24 are seen to be firmly mounted to the hub 22. The hub 22 is supported on one side by a circular backing plate 68. The backing plate 68 is attached at its center to a journal bearing 70 or similar bearing through which the hollow shaft 54 extends. The backing plate 68 is axially coupled to an indexing mechanism 72.

Figure 3:
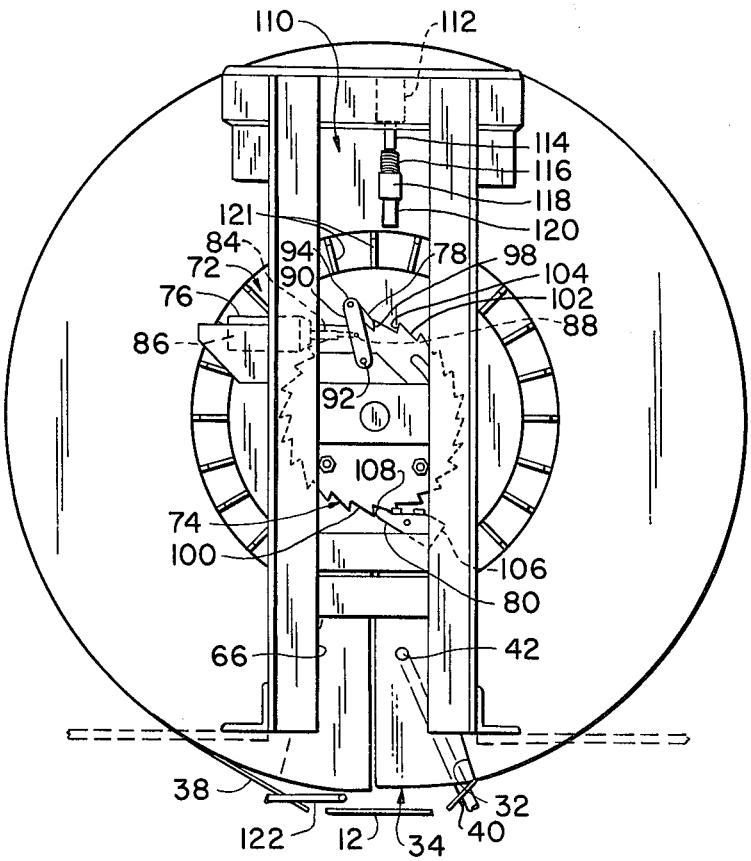
FIG. 3 is a rear elevational view in partial cutaway and partial cross section illustrating the apparatus.

Referring also to FIG. 3, the indexing mechanism 72 comprises a toothed ratchet gear 74, an indexing cylinder 76, a driving pawl 78, and an idler pawl 80. The toothed ratchet gear 74 is fixed to the backing plate 68 through spacers 82. The indexing cylinder 76 is a pneumatic cylinder such as an Allen Air Type A which has a piston 84 with a stroke of about 1 inch. The indexing cylinder 76 is pivotally mounted at one end 86 to the frame 62 and at the other or piston end 88 to the center of a generally vertically disposed lever 90. One end 92 is pivotally mounted to the frame 62. At the other end 94 of the lever 90, the driving pawl 78 is pivotally attached. The driving pawl 78 is mounted for pivoting in a generally vertical plane and is offset from the lever 90 by spacer 96 so that the pawl head 98 may rest freely on the top of the ratchet teeth 100 along the rim 102 of ratchet gear 74. The shape of the head 98 complements the shape of the face 104 of the gear teeth 100 so that the pawl head 98 and each ratchet tooth face 104 may interlock upon activation of the indexing cylinder 76. The driving pawl 78 is also disposed at an angle trailing the direction of rotation of the ratchet gear so that it does not interfere with ratchet gear rotation in the direction of the driving movement of the indexing cylinder 76.

Along the bottom of rim 102 is mounted the idler pawl 80. The idler pawl 80 includes a counterweighting end 106 and is mounted to pivot in a vertical plane so that its head 108 may rest against the ratchet gear teeth 100 by the force of gravity. The number and spacing of the teeth 100 correspond to the number and spacing of compartments 28 so that the indexing mechanism 72 always increments a minimum of one compartment location upon operation of the indexing cylinder 76.

The invention also includes a wheel stopping mechanism 110 which comprises a pneumatic reciprocating stop cylinder 112 similar to indexing cylinder 76. Stop cylinder 112 has a reciprocating piston 114 upon which is axially mounted a compression spring 116 which is coupled through a buffer coupling 118 to a stop 120. The stopping mechanism 110 is rigidly mounted on the edge of frame 62 so that stop 120, in extended position, extends between protrusions 121 of adjacent blades 24, temporarily preventing further advancement. The buffer coupling 118 and spring 116 link piston 114 with stop 120 so that upon actuation of stop cylinder 112, the stop 120 is urged between adjacent protrusions 121 to retard rotation of wheel hub 22.

The indexing mechanism 72 and the stopping mechanism 110 are operated by a control system. A container positioning sensor 122, which is preferably an optical sensor, is located adjacent the downstream face 33 in alignment with the inlet opening 30. The sensor 122 is for detecting the entrance of a box 14 approaching abutment with the downstream face 33, indicating that the box 14 is within an acceptable longitudinal range for lateral displacement of the wheel 20. The sensor 122 in operation thereupon provides a signal to increment the wheel 20, thereby permitting the next box 14 in sequence to begin entering the subsequent compartment 28. As soon as the previous box 14 has been displaced, the incrementing signal of the sensor 122 terminates.

Figure 4:
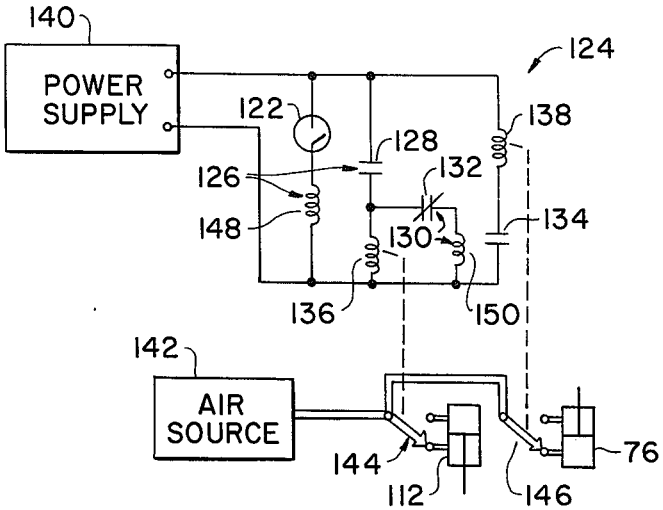
FIG. 4 is a schematic diagram of the electrical and pneumatic control system of the invention.

The operation of the sensor 122 in conjunction with the stopping mechanism 110 and the incrementing mechanism 72 will be better appreciated upon consideration of a detailed description of a suitable control system 124, as illustrated in FIG. 4. The control system 124 comprises the sensor 122 in the form of an on-off switch, a control relay 126 having contacts 128, a time delay relay 130 having timed trigger contacts 132 and slave contacts 134, a first or stop solenoid 136, a second or indexing solenoid 138, the stop cylinder 112, the indexing cylinder 76, an electrical power source 140, a pneumatic power source 142, which is generally a compressed air supply, a first two-way pneumatic switch 144, a second two-way pneumatic switch 146, and suitable pneumatic couplings between the pneumatic switches 144 and 146, the stop cylinder 112, the indexing cylinder 76 and the pneumatic source 142. The time delay relay may be a Time Delay Off Type relay as commercially available from manufacturers such as P & B Company.

The sensor switch 122 is coupled in series with the coil 148 of the control relay 126 across the electrical power source 140. The control relay contacts 128 are coupled across the electrical power source 140 in series with the stop solenoid 136 and also in series with the coil 150 of time delay relay 130 through the trigger contacts 132. The time delay relay slave contacts 134 are coupled across the electric power source 140 in series with the indexing solenoid 138. The stop solenoid 136 operates the first two-way pneumatic switch 144, which in a first position operates to retract the stop cylinder piston 114. The indexing solenoid 138 operates the second two-way pneumatic switch 146 which in its first position operates to drive the indexing cylinder 76. The stop cylinder 112 is arranged so that upon energization of the stop solenoid 136, the piston 114 retracts to permit free rotation of the ferris wheel 20 (shown in FIG. 2 and FIG. 3). The indexing cylinder 76 is arranged so that upon energization of the indexing solenoid 138, the piston 84 drives the pawl 78 (shown in FIG. 3) to advance the wheel 20 the width of one compartment 28.

The apparatus with the control system 124 coupled as described operates briefly as follows. The ferris wheel 20 is held stationary by the stop 120 of the stopping mechanism 110. A box 14 enters the inlet opening 30. The sensor switch 122, upon sensing the proper positioning of the box 14, causes the energization of the control relay 126 and the closing of its contacts 128 to simultaneously initiate the operation of stop cylinder 112 and the indexing cylinder 76. The ferris wheel 20 is indexed laterally. The timed trigger contacts 132 remain closed for a preset time delay to assure that the indexing solenoid 138 remains energized for a sufficient period of time to complete the indexing cycle. The stop solenoid 136 de-energizes after the box sensor switch 122 signals that a box 14 has been indexed from the inlet opening 30. (The period for this may be slightly shorter than the period for the indexing cycle.) As a result, the stop 120 is thrust by the reciprocating operation down between protrusions 121 to stop further motion as soon as the next protrusion 121 abuts against stop 120. Simultaneously, idler pawl 106 engages racket tooth 100 to prevent any backward motion of wheel 20. Thus, the inertial motion of the wheel 20 is retarded to prevent over-shoot which could cause undesired jamming between the blades 24 and subsequently entering boxes 14 before they fully clear the upstream face 31 at the inlet opening 30. Furthermore, this operational sequence also assures that the subsequent indexing of the wheel 20 cannot take place before the timed trigger contacts 132 have released and the indexing cylinder 76 has recovered to a ready position. The indexing cycle is repeated for each subsequently entering box. The boxes are thus inverted, thereby dumping loose contents into the hoppers 44 and 46. Each indexing operation and abrupt stopping operation also vigorously shake the wheel 20 and the boxes 14 therein to further aid in releasing debris.

The boxes 14 are released from the wheel 20 at the point where the compartment 28 aligns with the outlet opening 32. The box 14 at that point drops through the rim opening 34 and is carried off along path B by the conveyor belt 12 passing below. The air jet 42 stabilizes the exiting box 14 so that it does not tip backwards as it falls onto the belt 12.

The apparatus can operate in a relatively high speed environment, for example, at a transport speed of about 1 foot per second with boxes 14 stacked side to side, without danger of jamming.

The invention has been explained with reference to a particular preferred embodiment. In light of this disclosure, other embodiments will be apparent to those of ordinary skill in the art. Therefore, it is not intended that the invention be limited except as indicated by the appended claims.

What is claimed is:

1. Apparatus for removing debris from within open-topped containers during advancement along an endless conveyor, by interrupting the advancement of said containers at a first upright location along said conveyor, progressively inverting said containers and thereafter returning said containers to said conveyor at a second upright location no further advanced along said conveyor than said first location, comprising:

an open hub spaced above and rotatably mounted parallel to said conveyor advancement;

a plurality of blades each attached along a first edge portion to and extending radially from said hub for rotation adjacent to and across said conveyor advancement, said blades being spaced apart to provide adjacent compartments radially disposed around said hub, said compartments being of a dimension sufficient to accommodate at least one container, said hub being further provided with means adjacent to the radially inward end portion of said blades to support said containers against the force of gravity when said containers are near or at inversion;

wall-type structure enclosing other than said first edge of said blades to constrain said containers from falling out of said compartments during rotation of said blades, said wall-type structure including an upstream face defining a container inlet opening overlying said conveyor, a downstream face defining a container outlet opening overlying said conveyor and laterally offset from said inlet opening in a direction opposite to the direction of rotation of said hub, a circular peripheral face spanning said upstream and downstream faces except for an opening generally overlying said conveyor between said inlet and outlet openings;

indexing means to incrementally rotate said hub to transfer said containers from an upright position at said inlet opening to an upright position at said outlet opening;

means for limiting the length and frequency of said incremental rotation;

means for sensing the passage through said inlet opening of at least one of said containers and incrementally advancing said hub so as to provide access to the next adjacent compartment; and means within said hub for accumulating debris which falls through said hub when containers are transferred through said inverted position.

2. A box inverting apparatus according to claim 1 wherein said sensing means comprises an optical sensor disposed on the downstream side of said housing.

3. A box inverting apparatus according to claim 1 further including an air jet disposed in line with the outlet opening on the upstream face at a level approaching the height of a container disposed at the outlet opening for directing a stream of air in a downstream direction for stabilizing an exiting container.

4. An apparatus according to claim 1 further including a control system comprising:

a pneumatic stopping cylinder;

a pneumatic indexing cylinder;

a first solenoid-operated pneumatic control valve having a first position for advancing said stop cylinder and a second position for retracting said stopping cylinder;

a second solenoid-operated pneumatic control valve having a first position for introducing pressurized gas to advance said indexing cylinder and a second position for retracting said indexing cylinder;

relay means responsive to said sensing means to control said first and second solenoid means, said relay means being operative to cause the simultaneous actuation of said first and second solenoid means, said first solenoid means causing the retraction of said stopping cylinder and said second solenoid means causing the indexing of said indexing cylinder;

said first solenoid being further operative to apply a brake to retard rotation of said rotating means upon a signal from said sensing means indicating the absence of a container at said inlet opening; and timing means coupled to said indexing solenoid for maintaining said first position for a predetermined time period.

5. An apparatus according to claim 4 wherein said timing means comprises a time delay off relay having timed trigger contacts under control of said relay means and slave contacts coupled to control said indexing solenoid.

* * * * *